US006247957B1

(12) United States Patent
Hasegawa

(10) Patent No.: US 6,247,957 B1
(45) Date of Patent: Jun. 19, 2001

(54) CONNECTOR WITH DETECTION MEMBER

(75) Inventor: Teruaki Hasegawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/579,016

(22) Filed: May 26, 2000

(30) Foreign Application Priority Data

May 28, 1999 (JP) ..... 11-150566

(51) Int. Cl.[7] ..... H01R 13/627
(52) U.S. Cl. ..... 439/352
(58) Field of Search ..... 439/489, 607, 439/862, 188, 372, 488, 352, 350–354, 357–358

(56) References Cited

U.S. PATENT DOCUMENTS

| | | | | |
|---|---|---|---|---|
| 5,628,648 | | 5/1997 | Higgins, Jr. et al. . | |
| 5,830,002 | * | 11/1998 | Ito et al. | 439/358 |
| 5,910,028 | * | 6/1999 | Tsuji | 439/489 |
| 6,109,955 | * | 8/2000 | Hanazaki et al. | 439/489 |
| 6,126,496 | * | 10/2000 | Shinozaki | 439/862 |

FOREIGN PATENT DOCUMENTS

| | | | | |
|---|---|---|---|---|
| 9-283216 | * | 4/1996 | (JP) | 439/489 |
| 11-354211 | * | 6/1998 | (JP) | 439/489 |

* cited by examiner

*Primary Examiner*—Brian Sircus
*Assistant Examiner*—J. F. Duverne
(74) *Attorney, Agent, or Firm*—Banner & Witcoff, Ltd.

(57) ABSTRACT

A detecting member 40 is attached within a female electrical connector housing 20 in a manner whereby it is capable of moving in a width-wise direction. A contacting face 47 of a detecting protrusion 46 of a detecting arm 45 makes contact with a locking arm 26 when this locking arm 16 is in a free state prior to two housings 10 and 20 being fitted together, this contact regulating the movement of the detecting member 40. When the two housings 10 an 20 are being fitted together, the contact face 47 of the stopper arm 45, and a side face 53 of a main body 41 make contact with a side face 51 of the bent locking arm 26, thereby regulating the movement of the detecting member 40. After correct fitting is completed, the locking arm 26 returns to its original position. Consequently, the contacting state of the stopper arm 45 and the main body 41 with the side face 51 is released, thereby allowing the detecting member 40 to be moved to a position indicating correct fitting of the housings 10, 20.

9 Claims, 11 Drawing Sheets

CONNECTOR WITH DETECTION MEMBER

TECHNICAL FIELD

The present invention relates to an electrical connector provided with a fitting detecting function.

BACKGROUND TO THE INVENTION

Conventional electrical connectors provided with a fitting detecting member for detecting whether male and female connector housings are in a fitted state include the one described in U.S. Pat. No. 5,628,648. In this kind of connector, as shown in FIG. 20 of this specification, a see-saw like locking arm 2 provided on a female housing 1 inclines when a fitting operation of two housings 1 and 3 is performed. The locking arm 2 uses a support 2A as a pivot, an anterior end thereof moving upwards, and a posterior end thereof moving downwards. When the two housings 1 and 3 are correctly fitted together, this locking arm 2 returns to its original position and is latched by a locking member 3A of the male housing 3. A detecting member 4 is attached in a unified manner within the locking arm 2, this detecting member being capable of sliding in an anterior-posterior direction. When the two housings 1 and 3 are not yet fitted together, this detecting member 4 is located at the posterior of the support 2A. A regulating protrusion 4A protrudes from an upper face of the detecting member 4. The regulating protrusion 4A engages with a supporting member 1A of the female housing 1, this supporting member 1A surrounding the support 2A. As a result, movement of the detecting member 4 into a movement space 5 of the locking arm 2 to the anterior of the supporting member is prevented.

When the two housings 1 and 3 are being fitted together, the detecting member 4 inclines along with the locking arm 2, and the locking arm 2 is positioned in the movement space 5 in this inclined state. Consequently, movement of the detecting member 4 in an anterior direction is prevented. When the two housings 1 and 3 are correctly fitted together, the locking arm 2 returns to its original position and leaves the movement space 5, the detecting member 4 can now be pushed in. As a result, the engagement of the regulating protrusion 4A with the supporting member 1A is released and the detecting member 4 can be moved into the movement space 5, thereby allowing one to detect that the two housings 1 and 3 are correctly fitted together.

When the detecting member 4 is pushed in, an anterior end face of the regulating protrusion 4A pushed against an upper wall portion 1B of the supporting member 1A, the regulating protrusion 4A enters under the upper wall portion 1B and this upper wall portion 1B is simultaneously bent forcefully upwards. In this manner, a pushing force which is large enough to forcefully bend the upper wall portion 1B upwards is required to move the detecting member 4. Consequently, the movement operability thereof is poor. The regulating protrusion 4A and the supporting member 1A are released by reverse movement.

The present invention has been developed in response to the circumstances described above, and aims to improve the movement operability of the detecting member when the two housings are correctly fitted together.

SUMMARY OF THE INVENTION

According to the invention there is provided a connector comprising first and second housings engageable in a fitting direction, said first housing having a resilient latching arm engageable with a latching formation of said second housing, and said first housing having a detecting member, said latching arm being movable from a rest position into a space during fitting of said housings, and being movable out of said space to said rest position on engagement with said latching formation, and said detecting member being movable into said fitting space on engagement of said latching arm and latching formation, characterised in that said detecting member is movable from a passive position in a direction at right angles to said fitting direction, the detecting member having a resilient locking arm engageable with a side of said latching arm in said rest position, and said first housing having a releasing member engageable with said locking arm during fitting of said housings, to cause said locking arm to bend and thereby be enabled to enter said space.

Such an arrangement allows the locking arm to be bent as the housings are pushed together; accordingly the insertion force of the detecting member can be low.

Preferably the locking arm is engageable with the latching arm until bent by the releasing member, and irrespective of the position of the latching arm. In a preferred embodiment the locking arm is engageable with the latching arm after insertion into the space.

Preferably the latching arm and the locking arm resume an unbent condition when respectively in the rest and passive positions. In this way a permanent set of the arms is avoided, and resilience is maintained.

The detecting member may be guided on the second housing by a peg and slot guide. The detecting member may itself comprise a main body guided on the second housing, and from which said locking member protrudes.

BRIEF DESCRIPTION OF THE DRAWINGS

Other aspects of the invention will be apparent from the following description of a preferred embodiment shown by way of example only in the accompanying drawings in which.

DESCRIPTION OF PREFERRED EMBODIMENT

Figure 1:
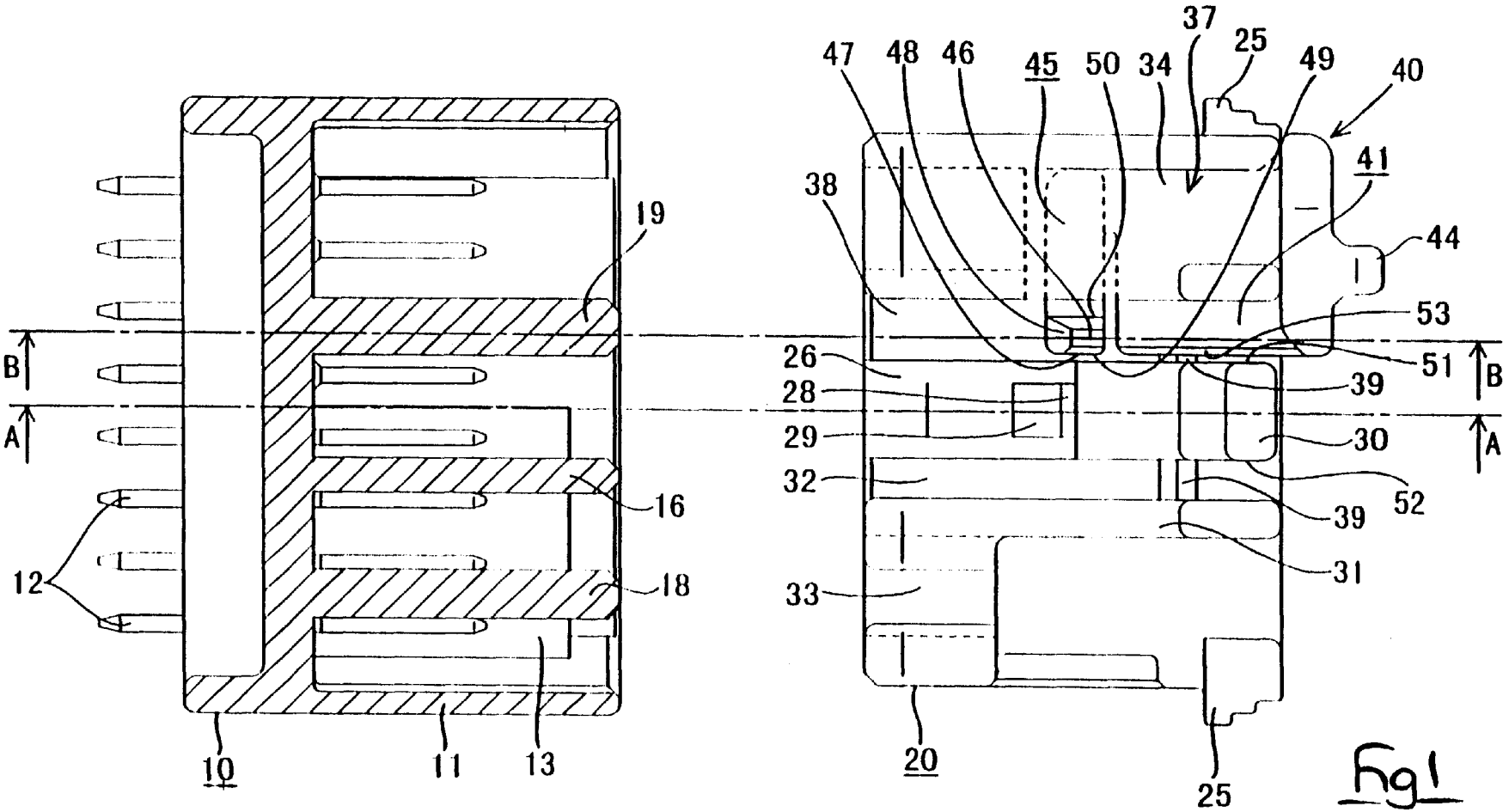
FIG. 1 is a partially cut-away plan view of an embodiment of the present invention showing a connector prior to being fitted together.

An embodiment of the present invention is described below with the aid of FIGS. 1 to 19. As shown in FIG. 1, a connector of the present embodiment comprises a male connector housing 10 and a female connector housing 20 provided with a locking arm 26, these two housings 10 and 20 fitting mutually together. The female housing 20 is provided with a detecting member 40 for detecting whether the two housings 10 and 20 are correctly fitted together. Furthermore fitting face sides of the housings 10 and 20 will be referred to below as being the anterior.

Figure 2:
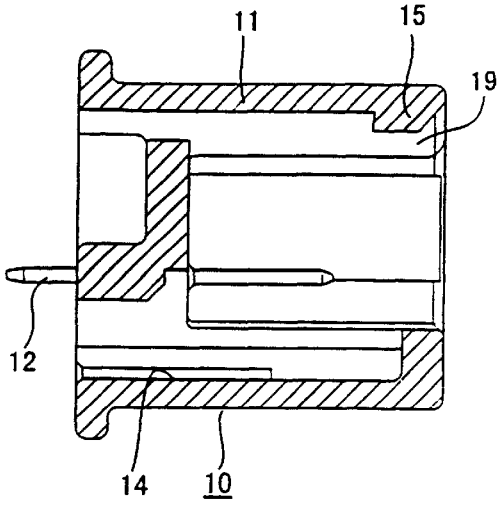
FIG. 2 is a cross-sectional view of FIG. 1 along the line A—A.
Figure 2:
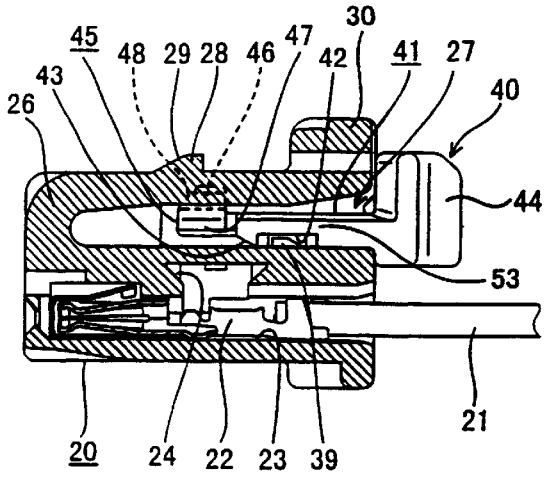

As shown in FIGS. 1 and 2, a hood 11 protrudes to the anterior of the male housing 10, this hood 11 being capable of fitting with the female housing 20. Eight male terminal fittings 12 having both ends formed in a tab shape are aligned in a width-wise direction within the male housing 10. One end of each male terminal fitting 12 protrudes into the hood 11, the other end protrudes to the exterior of the male housing 10. A shorting terminal housing member 14 for housing a shorting terminal 13 is formed in the hood 11 (at the lower left in FIG. 4). This shorting terminal 13 makes contact with the four male terminal fittings 12 on the left in FIG. 4, and causes a short-circuit therebetween.

As shown in FIG. 2, a locking claw 15 protrudes downwards from a central portion of an upper face of the hood 11, this locking claw 15 engaging with the locking arm 26 of the female housing 20. A guiding rib 16 (shown on the left in FIG. 4) and a releasing rib 19 (on the right) protrude downwards from the locking claw 15. As shown in FIG. 1, anterior end faces of the guiding rib 16 and the releasing rib 19 are level with an anterior end face of the hood 11.

Figure 4:
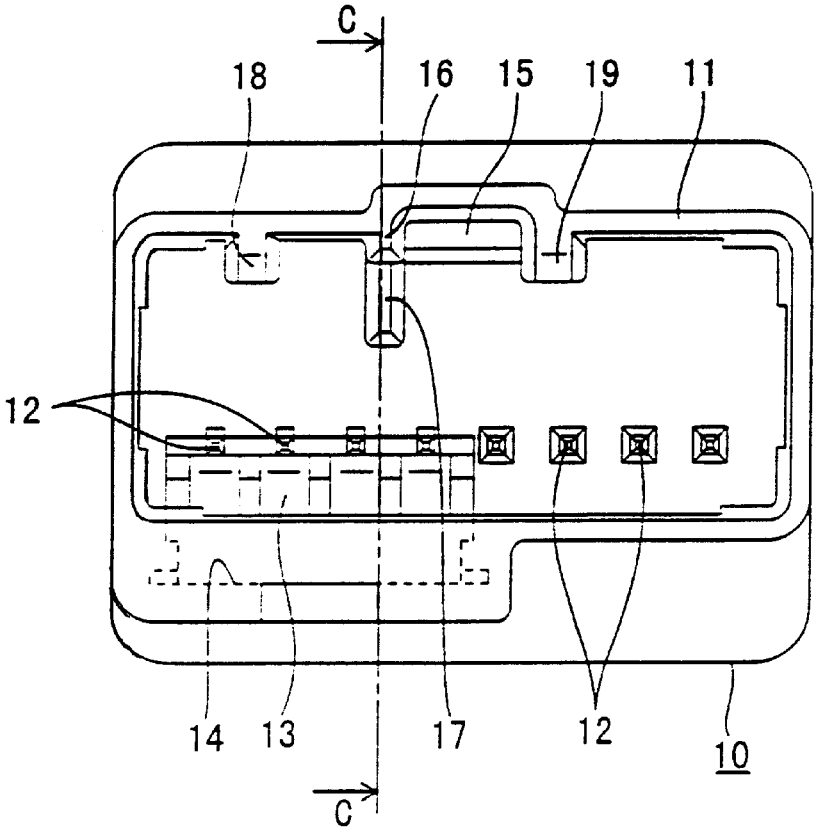
FIG. 4 is a front view of a male housing
Figure 5:
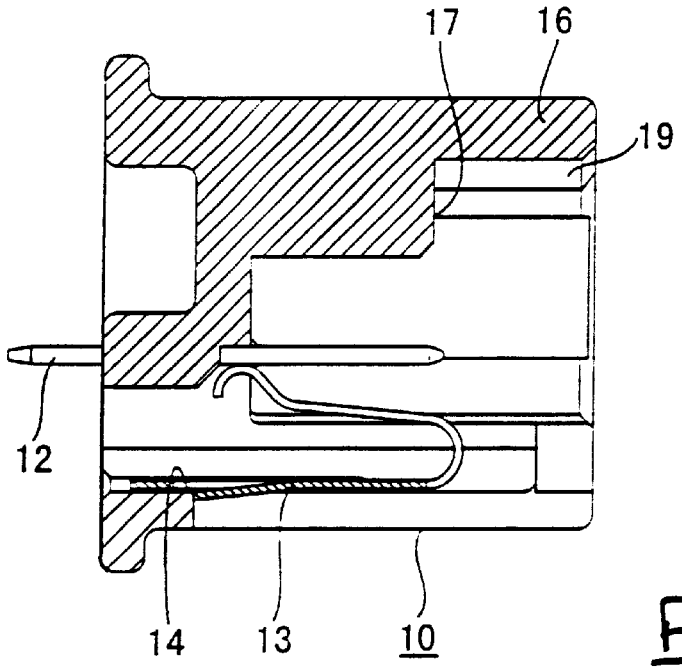
FIG. 5 is a cross-sectional view of FIG. 4 along the line C—C.

The guiding rib 16 fits into a guiding groove 32 formed on the female housing 20, thereby guiding the fitting of the two housings 10 and 20. As shown in FIG. 5, a block-like portion 17 of a specified size is formed on an anterior side lower portion of the guiding rib 16. Further, as shown in FIG. 4, a guide rib 18 protrudes at a location to the left of the guiding rib 16, is separated therefrom by a space and is formed at a location where the portion 17 is not provided. This guiding rib 18 has a shape different from the guiding rib 16, but performs the same function.

As shown in FIG. 1, the releasing rib 19 fits into a groove 38 formed on the female housing 20. When the releasing rib 19 has been inserted into the groove 38, this releasing rib 19 engages with a stopper arm 45 of the detecting member 40, this stopper arm 45 protruding into the groove 38. A detailed explanation thereof appears below. The releasing rib 19 performs the same guiding function as the guiding ribs 16 and 18.

Figure 6:
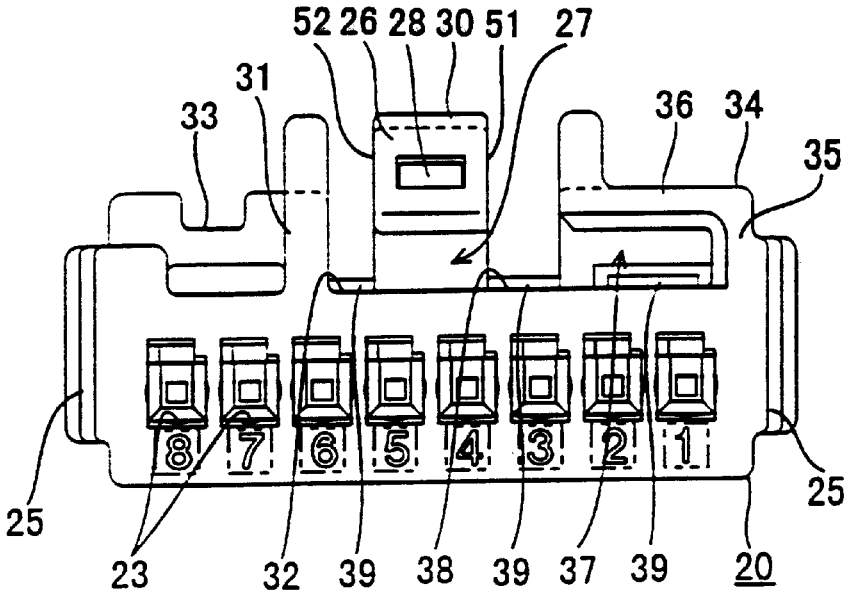
FIG. 6 is a rear face view of FIG. 4 along the line C—C.

As shown in FIG. 6, the female housing 20 is block-like. Eight cavities 23 are aligned therein at locations corresponding to the male housing 10. Female terminal fittings 22 having ends of electric wires 21 attached thereto are housed within these cavities 23. A through hole 24 is cut horizontally into each cavity 23 of the female housing 20, a retainer (not shown) is fixed within these through holes 24, thereby latching each female terminal fitting 22 in the housing 20. Further, a pair of fitting operating members 25 protrude from both side faces of the female housing 20 for fitting the male housing 10 thereto.

As shown in FIGS. 1 and 2, the cantilever shaped locking arm 26 is provided at a central portion of an upper face of the female housing 20, this locking arm 26 extending in the direction of fitting of the two housings 10 and 20. A base side of the locking arm 26 is formed on an anterior end portion of the female housing 20, and a free end thereof extends towards the posterior. A posterior end face thereof is level with a posterior end face of the female housing 20. When the locking arm 26 is in a free state, it can be bent upwards or downwards with the base thereof serving as a fulcrum. A bending space 27 is formed below the locking arm 26, the locking arm 26 being capable of entering therein.

Figure 10:
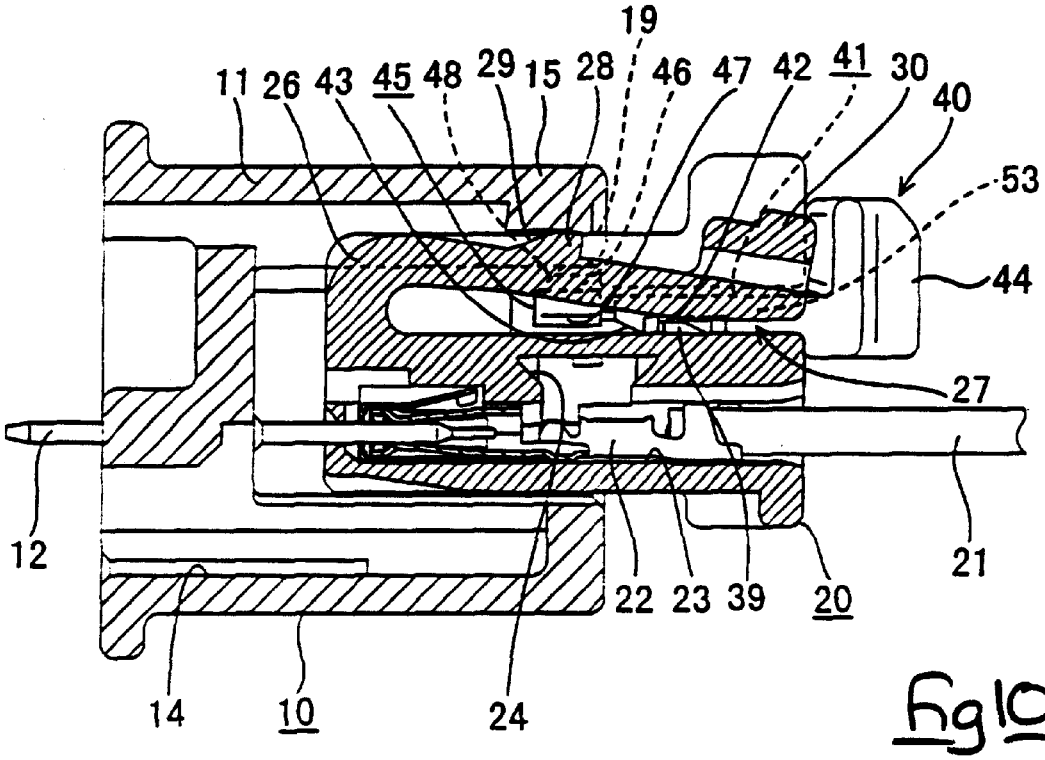
FIG. 10 is a cross-sectional view showing the two housings of FIG. 2 while being fitted together.
Figure 13:
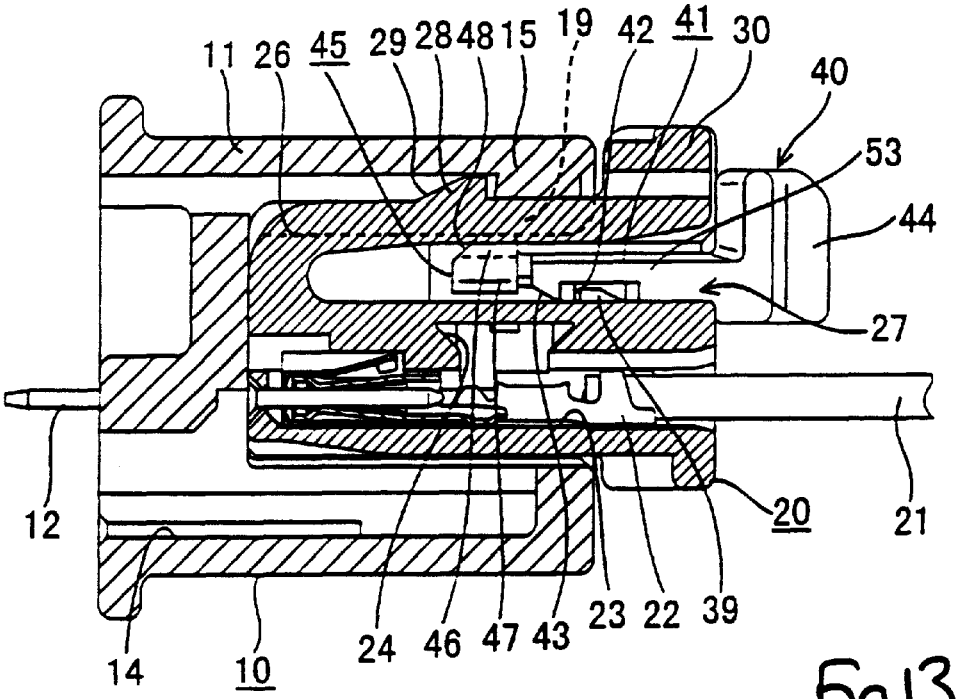
FIG. 13 is a cross-sectional view showing the two housings of FIG. 2 in a state where fitting is completed.

A locking protrusion 28 is formed in an upper face of the locking arm 26 at an approximately central position in a length wise direction. The locking claw 15 of the male housing 10 fits with this locking protrusion 28. When the two housings 10 and 20 are being fitted together, as shown in FIG. 10, a tapered face 29 formed at an anterior end face of the locking protrusion 28 makes contact with the locking claw 15, thereby bending the locking arm 26 downwards. When fitting has been completed, as shown in FIG. 13, the locking claw 15 catches with the locking protrusion 28, thereby maintaining the two housings 10 and 20 in the fitted state. Moreover, a pressing operating member 30 protrudes from an upper face of the free end of the locking arm 26. The locking arm 26 can be made to bend by pressing the pressing operating member 30.

A side wall 31, shown to the left of the locking arm 26 in FIG. 6, is formed with a specified space being provided between the locking arm 26 and the side wall 31. The guide groove 32 is formed between the locking arm 26 and the side wall 31. The guiding rib 16 of the male housing 10 fits into this guiding groove 32. A guide groove 33 is formed to the left of this guiding groove 32, the guiding rib 18 of the male housing 10 fitting therein.

Figure 7:
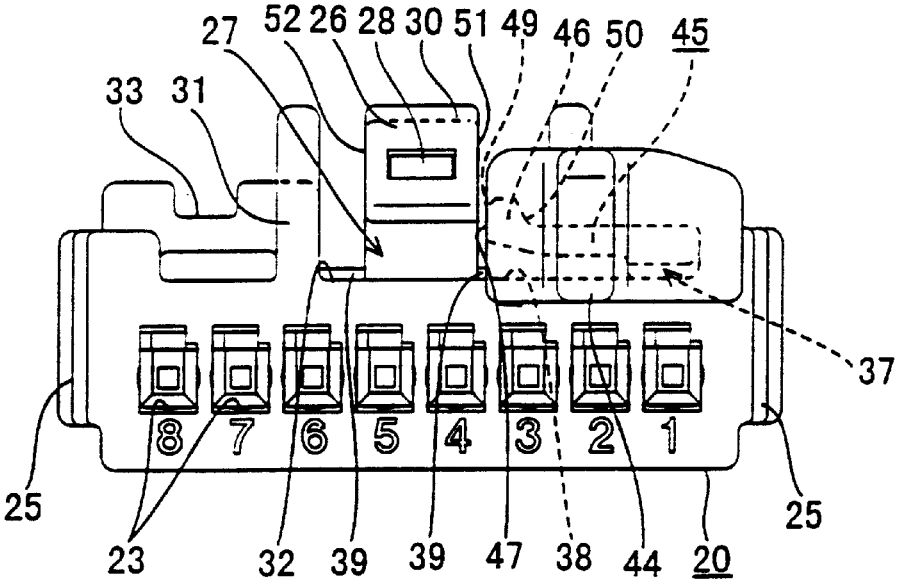
FIG. 7 is a rear face view of the female housing with a detecting member in an attached state.

A surrounding wall 34, shown to the right of the locking arm 26 in FIG. 6, is formed with a specified space being provided between the locking arm 26 and the surrounding wall 34. The groove 38 is formed between the locking arm 26 and the surrounding wall 34. The releasing rib 19 of the male housing 10 fits into this groove 38. The surrounding wall 34 is formed in a cross-sectionally L-shape and has a base member 35 formed at the right side of the female housing 20, and a ceiling face member, 36 extending to the left at approximately a right angle at a specified height. As shown in FIG. 7, the space surrounded by the base member 35 and the ceiling face member 36 forms a housing space 37. The detecting member 40 of the present invention is attached therein.

Figure 8:
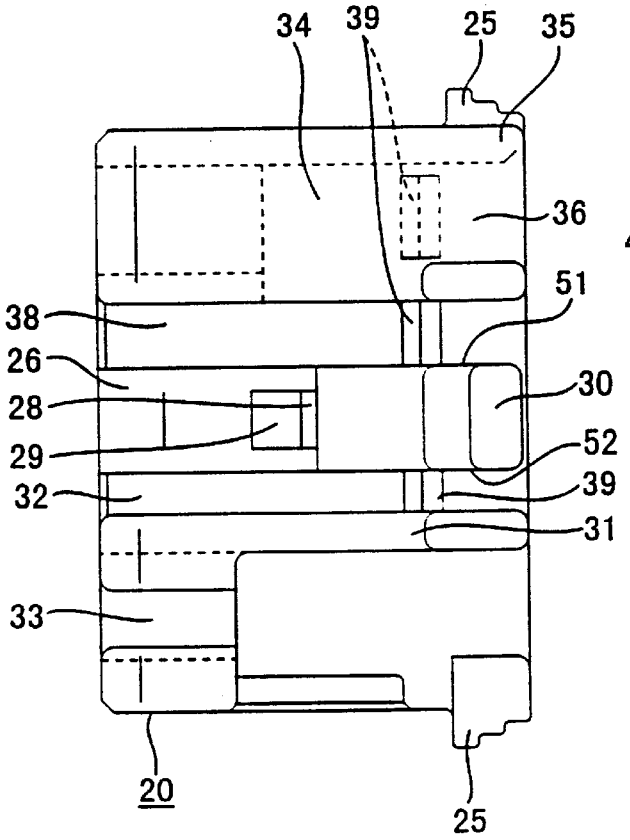
FIG. 8 is a plan view of the female housing and the detecting member.
Figure 8:
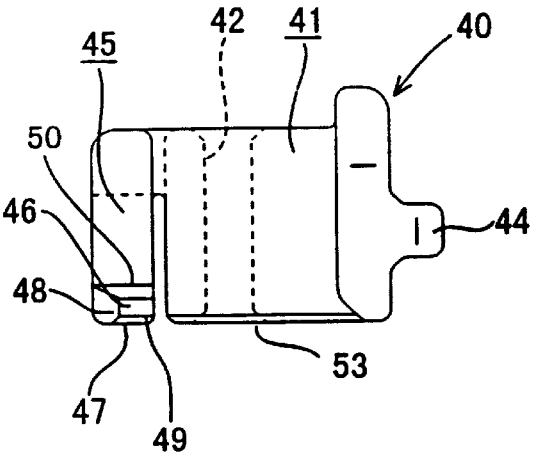

As shown in FIGS. 6 and 8, the upper face of the female housing 20, on which the guiding groove 32, the groove 38, and the housing space 37 are provided, has three protruding members 39 formed thereon, these protruding members 39 being formed separately and along the same line in a width-wise direction.

Figure 17:
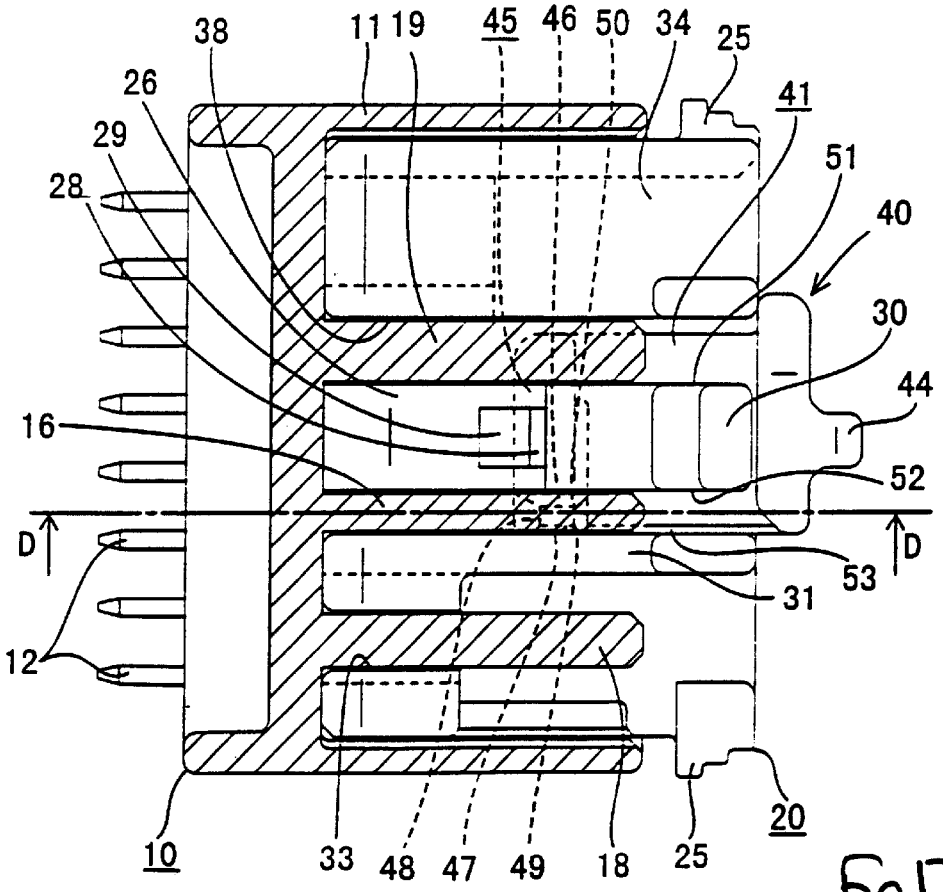
FIG. 17 is a partially cut-away plan view showing the detecting member in a moved state.

As shown in FIG. 1, the detecting member 40 attached within the female housing 20 straddles the housing space 37 and the groove 38. The detecting member 40 is capable of moving in a width-wise direction of the female housing 20, that is, in a direction at right angles to the direction of fitting of the two housings 10 and 20. As shown in FIG. 17, the detecting member 40 extends from the groove 38 to the guiding groove 31 after it has been moved.

Figure 3:
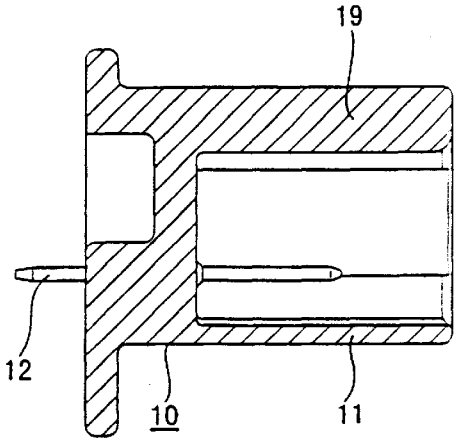
FIG. 3 is a cross-section view of FIG. 1 along the line B—B.
Figure 3:
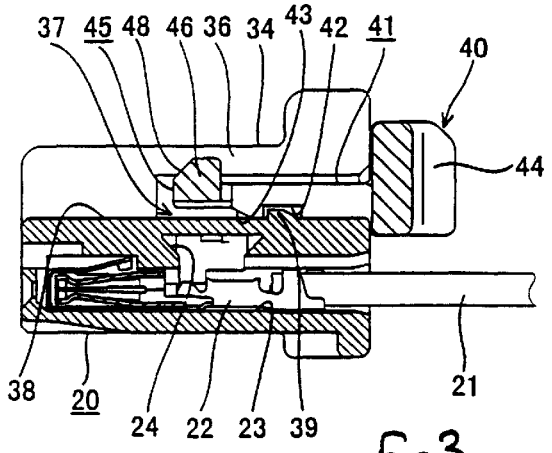
Figure 9:
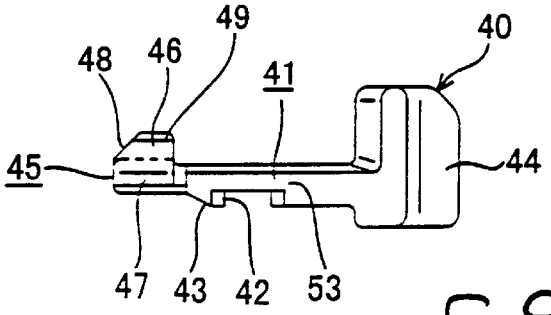
FIG. 9 is a front view of the detecting member.

As shown in FIG. 1 and 8, the detecting member 40 is provided with a plate-like main body 41 which extends substantially across the upper face of the female housing 20, a stopper arm 45 provided at the anterior of the main body 41, and an operating member 44 at the posterior. As shown in FIGS. 8 and 9, a groove 42 is provided on a lower face of the detecting member 40, this groove 42 extending in a width-wise direction of the female housing 20, that is, in the direction of movement of the detecting member 40. This groove 42 fits with one of the protruding members 39 on the upper face of the female housing 20. Further, a tapered face 43 is formed at an anterior lower face of the groove 42. When the detecting member 40 is attached to the female housing 20, this tapered face 43 allows the main body 41 to pass easily over the protruding member 39 (see FIG. 3). The fitting together of the groove 42 and the protruding member 39 guides the movement of the detecting member 40 in a width-wise direction within the female housing 20 and, as shown in FIG. 3, stops the detecting member 40 in an anterior-posterior direction.

When the detecting member 40 is in an attached state within the female housing 20, as shown in FIG. 1, the operating member 44 at the posterior of the main body 41 protrudes from the posterior end face of the female housing 20. An operator can move the detecting member 40 by manipulating this operating member 44.

As shown in FIGS. 8 and 9, the stopper arm 45 at the anterior of the main body 41 has a cantilevered shape. A base end thereof is joined with the end of the main body 41 which is farther from the locking arm 26, and a free end thereof protrudes in a width-wise direction of the female housing 20, that is, in a direction at right angles to the direction of fitting of the two housings 10 and 20. The free end of the stopper arm 45 is even with an end face 53 of the main body 41, this end face 53 facing the locking arm 26. The free end of the stopper arm 45 can be bent in the same direction as the locking arm 26, with the base end thereof serving as a fulcrum. When the detecting member 40 is in an attached state within the female housing 20, an upper face of the stopper arm 45 is slightly below a lower face of the locking arm 26, as shown in FIG. 7. Further, as shown in FIG. 1, the stopper arm 45 is to the posterior of the locking protrusion 28 of the locking arm 26.

As shown in FIG. 9, a detecting protrusion 46 protrudes from an upper face of the free end of the stopper arm 45. As shown in FIGS. 1 and 7, when the detecting member 40 is in an attached state within the female housing 20, the free end of the stopper arm 45 and the detecting protrusion 45 protrude into the groove 38. A side face of the detecting protrusion 46 (to the left side face in FIG. 7) forms a contacting face 47 which makes contact with a side face 51 on the right of the locking arm 26, the contact therebetween preventing the detecting member 40 from moving to the left, relative to FIG. 7. As shown in FIG. 9, a leading face 48 is formed on an anterior end face of the detecting protrusion 46. This leading face 48 is inclined diagonally upwards and towards the posterior, and engages with the releasing rib 19 of the male housing 10 which fits into the groove 38, thereby causing the stopper arm 45 to bend, as shown in FIG. 12.

Figure 12:
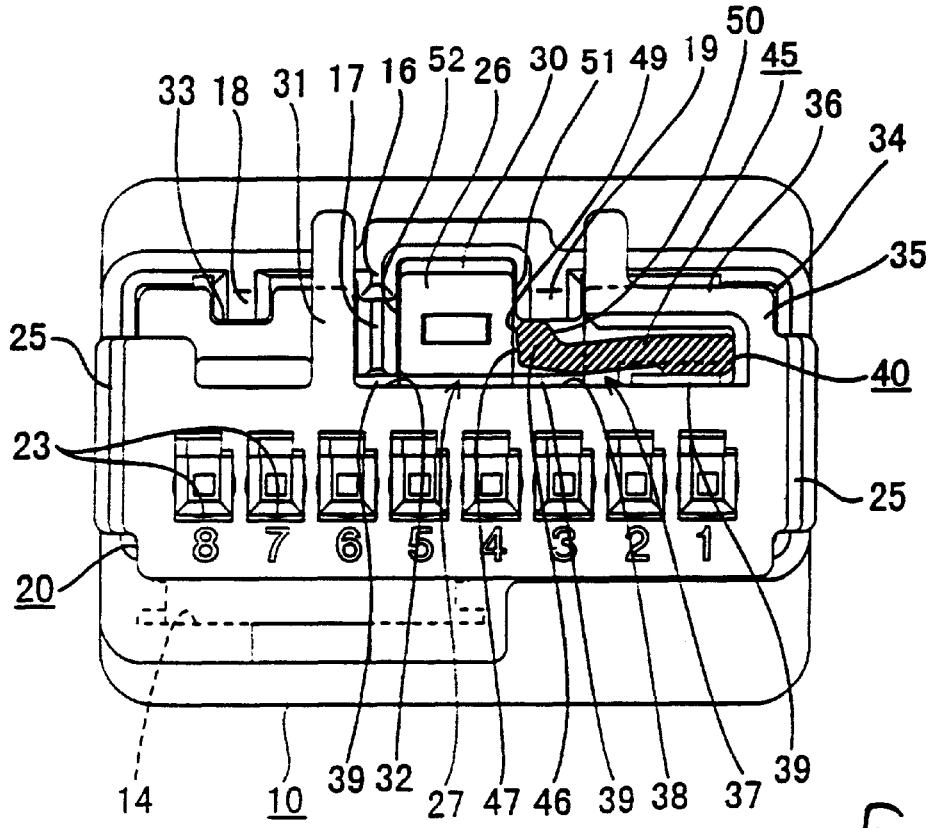
FIG. 12 is a partially cut-away rear face view showing the two housings while being fitted together.

As shown in FIGS. 10 and 12, the detecting member 40 makes contact with the bent locking arm 26. The locking arm 26 makes contact with the contacting face 47 of the detecting protrusion 46 of the stopper arm 45, the stopper arm 45 having been bent in the same direction as the locking arm 26; and the end face 53 of the main body 41, this end face 53 forming a unified face with the contacting face 47.

Figure 16:
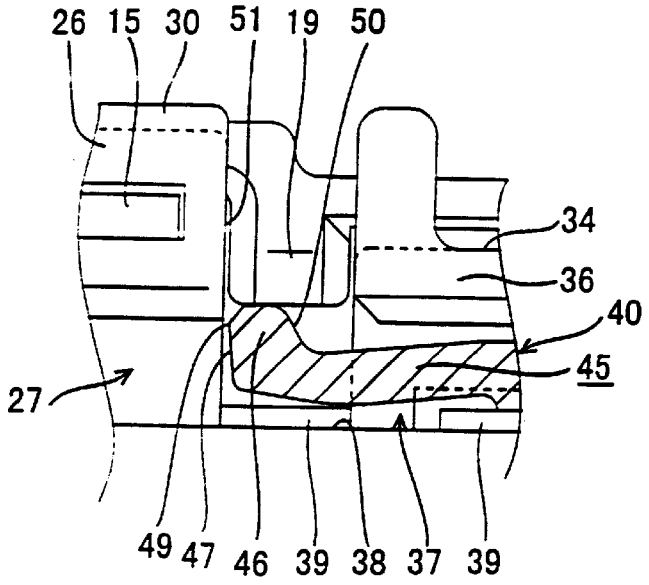
FIG. 16 is a partially cut-away expanded rear face view showing a catching state of the detecting protrusion and a side face of a locking arm.

As shown in FIG. 16, the stopper arm 45 which has been caused to bend by the locking arm 26 (which has returned resiliently to its original position) is maintained approximately at a height whereby it can be inserted into the bending space 27. An upper corner 49 of the contacting face 47 of the detecting protrusion 46 just catches with the side face 51 of the locking arm 26. In this state, the detecting member 40 cannot move unless the operating member 44 is pressed with more than a minimum specified degree of force.

Figure 18:
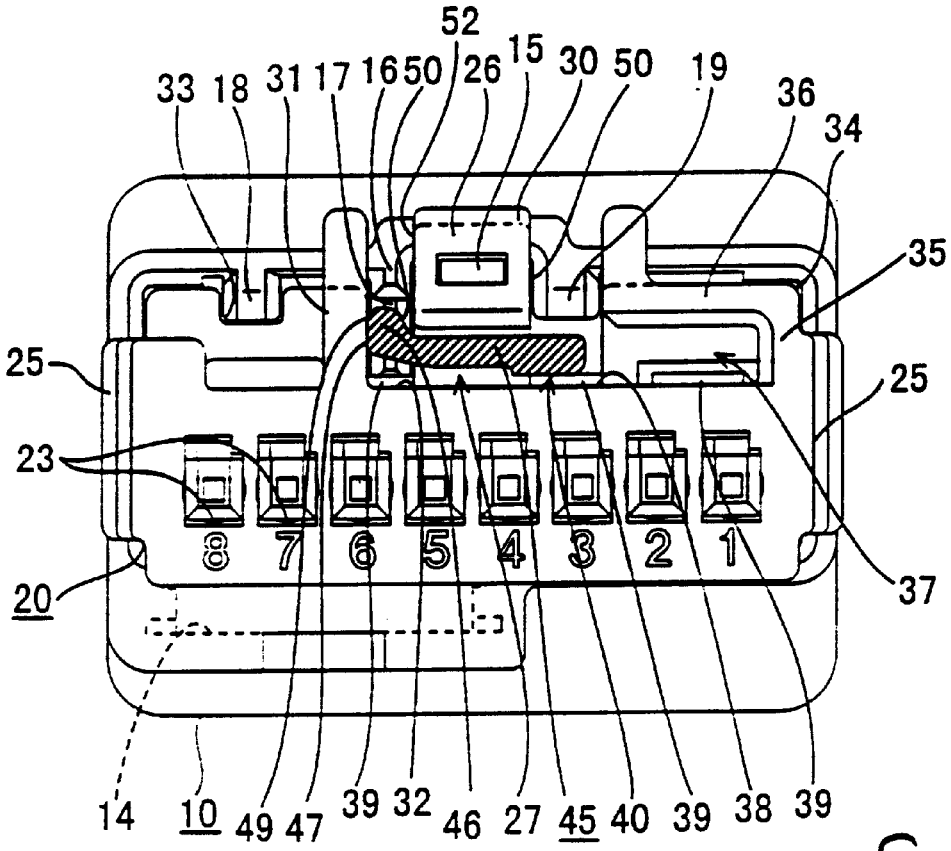
FIG. 18 is a partially cut-away rear face view showing the detecting member in the moved state.
Figure 19:
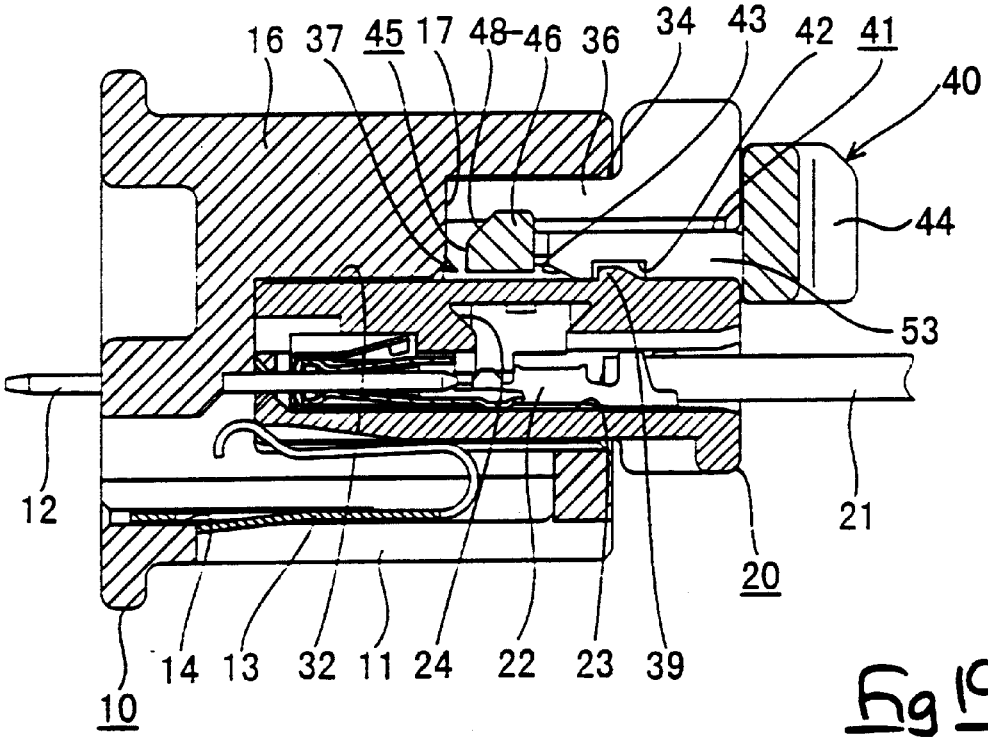
FIG. 19 is a cross-sectional view of FIG. 17 along the line D-D.
Figure 20:
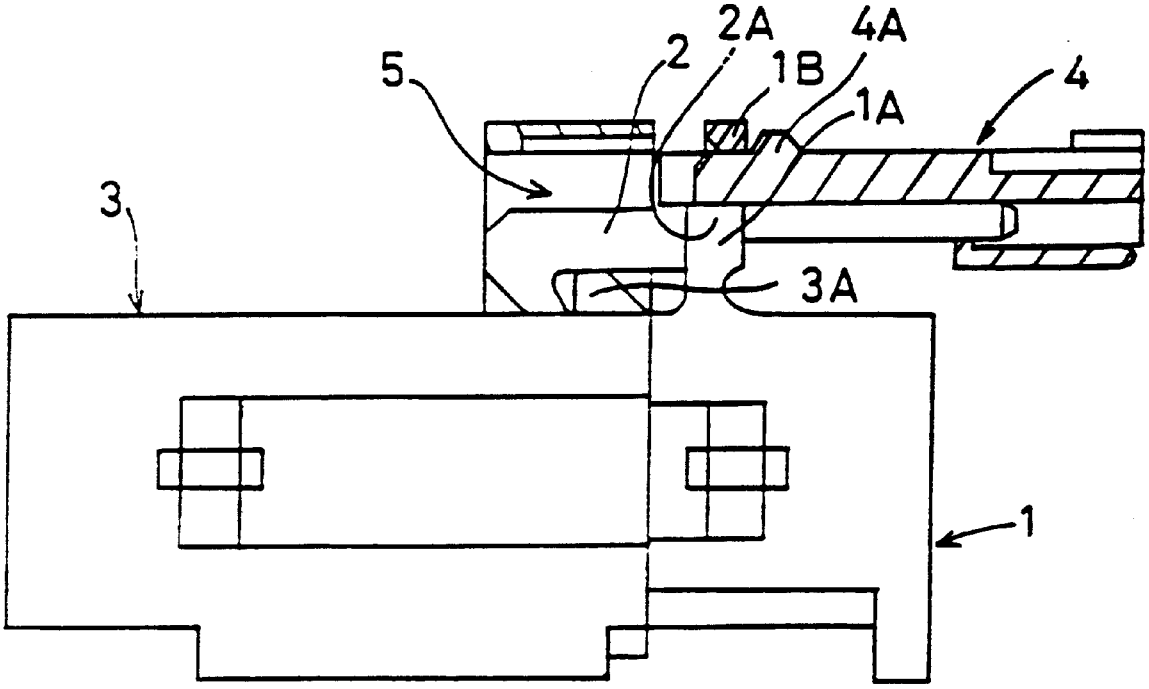
FIG. 20 is a partially cut-away side face view showing a prior art example.

When the detecting member 40 is caused to move to the position shown in FIG. 18, the stopper arm 45 straddles the bending space 27 under the locking arm 26 and comes to be located in the groove 38 and the guiding groove 31. As shown in FIG. 19, the detecting protrusion 46 comes to be located in the guiding groove 32, and is housed at the location of the cut-away portion 17 of the guiding rib 16 of the male housing 10. At this juncture, a side face of the detecting protrusion 46 (the right side face in FIG. 18) engages with a left side face 52 of the locking arm 26, thereby preventing the detecting member 40 from moving to the left. This side face is a stopping member 50.

The present embodiment is configured as described above; next, the operation thereof is explained. When the female housing 20 is fitted into the hood 11 of the male housing 10, as shown in FIG. 10, the locking claw 15 of the male housing 10 makes contact with the tapered face 29 of the locking protrusion 28 of the female housing 10, thereby bending the locking arm 26 into the bending space 27 therebelow. The stopper arm 45, which is in a free state, makes contact with the side face 51 at the right side of this bent locking arm 26 via the contacting face 47 at the left of the detecting protrusion 46, and the end face 53 of the main body 41, thereby preventing the detecting member 40 from moving to the left.

Figure 11:
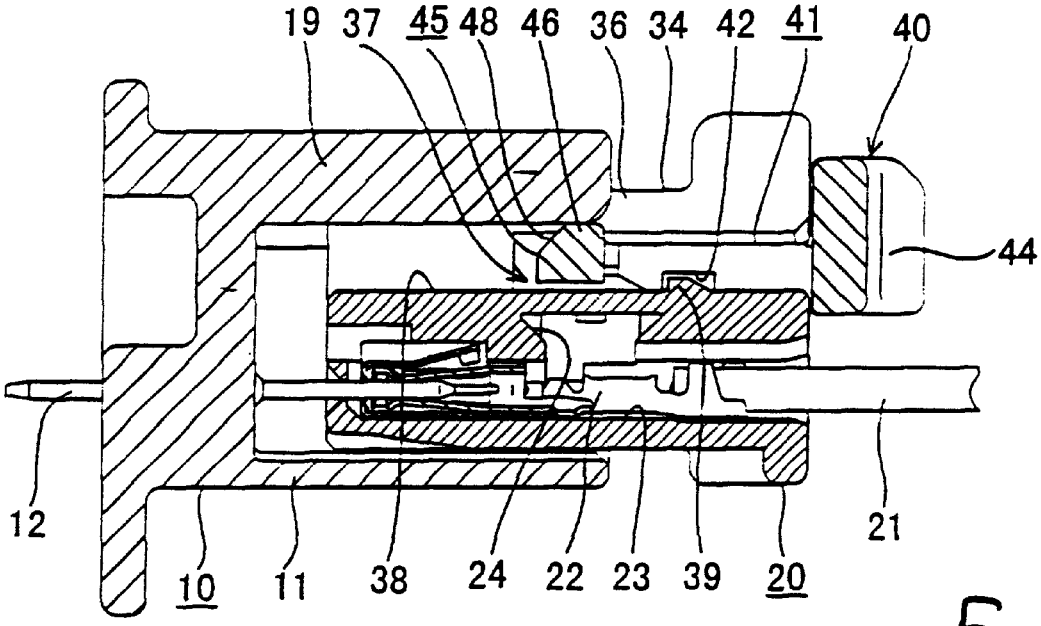
FIG. 11 is a cross-sectional view showing the two housings of FIG. 3 while being fitted together.

After the locking arm 26 has been bent, as shown in FIG. 11, the releasing rib 19 fitted within the groove 38 makes contact with the leading face 48 of the detecting protrusion 46-of the stopper arm 45, which is located to the posterior of the locking protrusion 28 (see FIG. 1 for the positional relationship of the leading face 48 and the locking protrusion 28). The detecting protrusion 46 is guided under the releasing rib 19 by the leading face 48, and the stopper arm 45 is bent downwards. At this juncture, as shown in FIG. 12, the contacting face 47 of the detecting protrusion 46 and the end face 53 of the main body 41 make contact with the side face 51 of the locking arm 26 which is in a bent state, thereby also preventing the detecting member from moving to the left.

Figure 14:
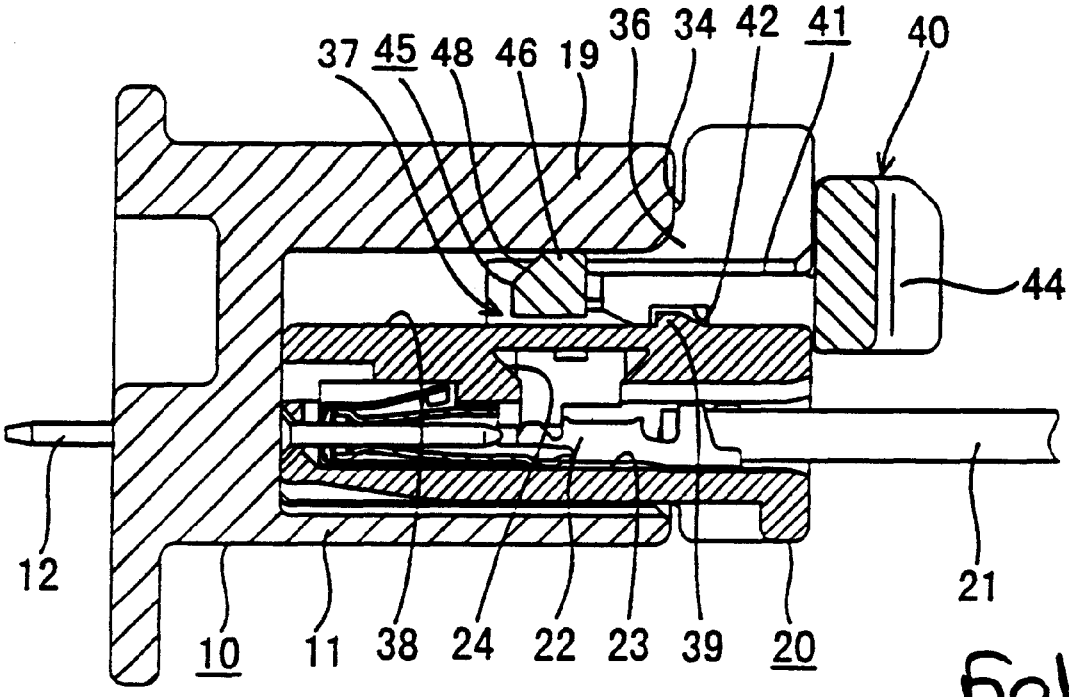
FIG. 14 is a cross-sectional view showing the two housings of FIG. 3 in the state where fitting is completed.
Figure 15:
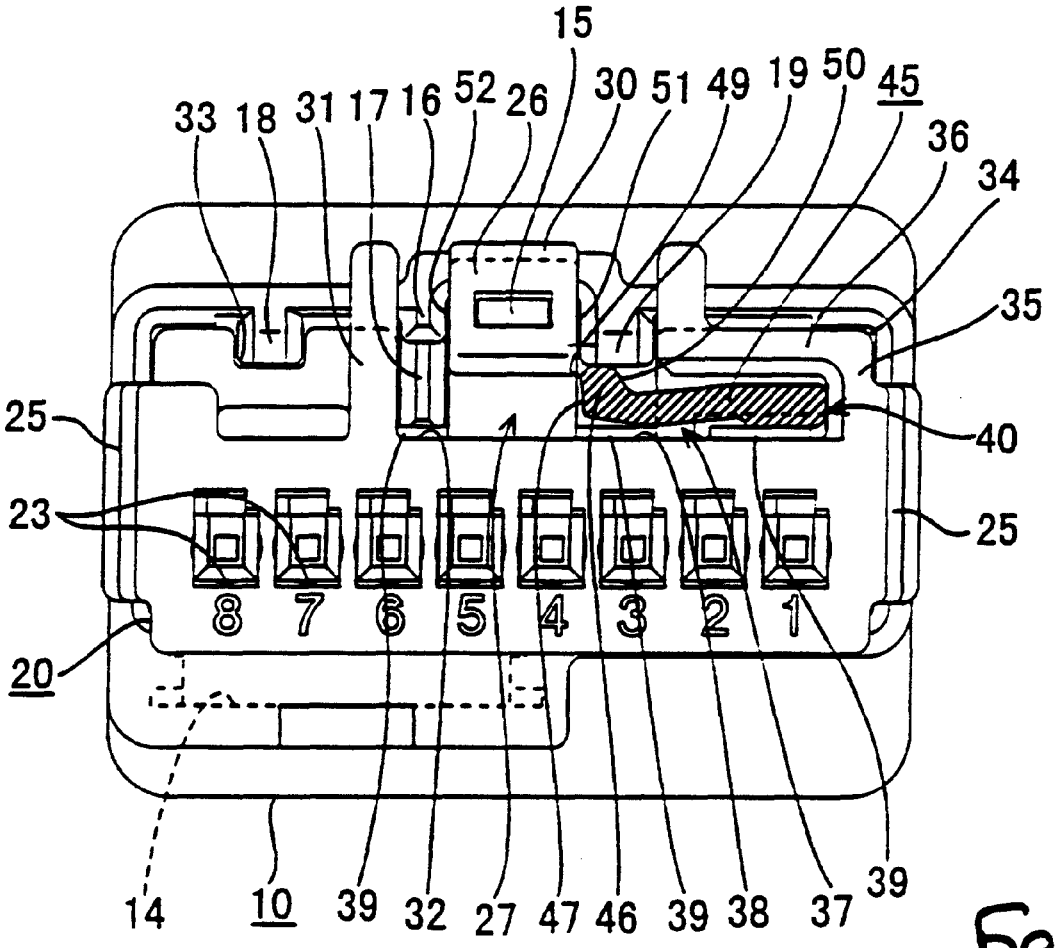
FIG. 15 is a partially cut-away rear face view showing the two housings in the state where fitting is completed.

When the fitting of the two housings 10 and 20 has been completed, as shown in FIG. 13, the locking protrusion 28 engages with the anterior of the locking claw 15 and the locking arm 26 rises upwards out of the bending space 27 and resiliently returns to its original position. At this juncture, the contacting state of the end face 53 of the main body 41 and the side face 51 of the locking arm 26 is released. Further, as shown in FIGS. 14 and 15, the detecting protrusion 46 is pressed down by the releasing rib 19, thereby maintaining the stopper arm 45 in a bent-down state. The stopper arm 45 is maintained approximately at a height wherefrom it can be inserted into the bending space 27 under the locking arm 26 which has returned resiliently to its original position. As shown in FIG. 16, the upper corner 49 of the contacting face 47 of the detecting protrusion 46 is in a state whereby it catches with the side face 51 of the locking arm 26 which has returned to its original position, this catching state being easily released.

From this state, the catching of the side face 51 of the locking arm 26 ands the corner 49 of the detecting protrusion 46 is totally released by pressing the operating member 44 in a leftwards direction, the detecting member 40 thereby moving to the left. At this juncture, the operating member 44 must be pressed with more than a minimum specified degree of force in order to make the detecting member 40 move. Consequently, the operator is able to determine with certainty that the detecting member 40 has moved. Furthermore, the requisite force is specified to be such that it will not impede the smooth movement of the detecting member 40.

The movement of the detecting member 40 is guided by the fitting together of the protruding member 39 of the female housing 20 and the groove 42 of the detecting member 40 (see FIG. 8). When the detecting member 40 is moved, the stopper arm 45, maintaining the bent state shown in FIG. 15, passes through the bending space 27 under the locking arm 26. The detecting protrusion 46 at the anterior end of the stopper arm 45 passes under the bending space 27 and comes to be located in the guiding groove 32 at the left side thereof. Thereupon, as shown in FIG. 18, the detecting protrusion 46 moves upwards and the stopper arm 45 returns resiliently to its original position. At this juncture, as shown in FIG. 19, the detecting protrusion 46 located in the guiding groove 32 is housed at the location of the portion 17 of the guiding rib 16 of the male housing 10 and, since the stopper arm 45 has returned resiliently to its original position, a permanent set does not occur.

At this juncture, as shown in FIG. 18, the stopping member 50 at the right side of the detecting protrusion 46 engages with the left side face 52 of the locking arm 26. As a result, the detecting member 40 is prevented from moving towards the left even if a pushing returning force is mistakenly applied to the right side thereof. In this manner, the detecting member 40 is moved to the position shown in FIGS. 17 and 18, and the correct fitting of the two housings 10 and 20 can thereby be detected.

The two housings 10 and 20 may need to be separated for maintenance or the like. In that case, a jig or the like is first used to bend the stopper arm 45, the stopped state of the side face 52 of the locking arm 26 with the stopping member 50 of the detecting protrusion 46 is released and, as shown in FIG. 15, the detecting member 40 is moved to its original position. After the detecting member 40 has left the bending space 27, the pressing operating member 30 is pressed downward,s thereby bending the locking arm 26 downwards. As a result, the engaged state of the locking protrusion 28 and the locking claw 15 is released, and the two housings 10 and 20 can be released from their fitted state.

According to the embodiment explained above, the contacting face 47 of the stopper arm 45 for regulating the movement of the detecting member 40 is in a contacting state with the side face 51 of the locking arm 26 before the two housings 10 and 20 are fitted together. However, they are automatically released from this contacting state by the releasing rib 19 as the two housings 10 and 20 are fitted together. As a result, the detecting member 40 obtains better operability of movement when the two housings 10 and 20 are correctly fitted together, compared to the case where a separate regulating means is provided for the detecting member 40 prior to fitting, and then a releasing operation is performed.

The detecting member 40 and the female housing 20 are provided with the groove 42 and the protruding member 39 respectively. Consequently, the function of guiding the movement of the detecting member 40 and the function of retaining the detecting member 40 in a posterior direction can be performed at the same time, the configuration of the detecting member 40 and the female housing thereby being simplified.

Moreover, in the above embodiment, when the two housings 10 and 20 are being fitted together, the detecting member 40 has two faces making contact with the side face 51 of the bent locking arm 26, that is, the contacting face 47 of the stopper arm 45 and the end face 53 of the main body 41. However, the end face 53 of the main body 41 may, for example, be provided at a location further inwards relative to the contacting face 47 of the stopper arm 45. In this case, only the contacting face 47 would make contact with the side face 51 of the locking arm 26 while fitting was occurring, and the movement of the detecting member 40 would thereby be regulated. That is, the stopper arm 45 is capable of regulating the movement of the detecting member 40 prior to the fitting together of the two housings 10 and 20, and while their fitting is occurring.

Furthermore, the present invention is not limited to the embodiments described above with the aid of figures. For example, the possibilities described below also lie within the technical range of the present invention. In addition, the present invention may be embodied in various other ways without deviating from the scope there.

(1) In the embodiment described above, when the two housings are being fitted together, the detecting member has two faces making contact with the side face of the bent locking arm, that is, the contacting face of the stopper arm and the end face of the main body. However, a configuration wherein only the end face of the main body makes contact is also possible. In that case, the stopper arm would regulate only the movement of the detecting member prior to the fitting together of the two housings.

(2) In the embodiment described above, the stopping member, which regulates the return of the detecting member to its original position after having been moved, and the contacting face, which regulates the movement of the detecting member prior to the two housings being fitted together, are provided by providing the protruding member (detecting protrusion) which protrudes from the anterior end of the stopper arm. However, the protruding member need not be provided in cases where the stopping member is not required. In that case, the contacting face may be provided at the anterior end face of the stopper arm.

(3) In the embodiment described above, the corner of the detecting protrusion just catches with the side face of the locking arm when the releasing rib presses the stopper arm downwards. However, this may be omitted, and the engagement of the stopper arm may be completely released by means of the releasing rib.

(4) Further, a configuration whereby the stopper arm does not return to a free state after the detecting member has been moved is also possible. This possibility lies within the range of the present invention.

What is claimed is:

1. A connector comprising first and second housings engageable in a fitting direction, said first housing having a resilient latching arm engageable with a latching formation of said second housing, and said first housing having a detecting member, said latching arm being movable from a rest position into a deflection permitting space during fitting of said housings, and being movable out of said space to said rest position on full engagement with said latching formation, and said detecting member being movable into said space on the engagement of said latching arm and latching formation, wherein said detecting member is movable into said space from a passive position in a direction at right angles to said fitting direction, the detecting member having a resilient locking arm engageable with a side of said latching arm in said rest position, and said second housing having a releasing member engageable with said locking arm during fitting of said housings, to cause said locking arm to bend and thereby be enabled to enter said space below the latching arm.

2. A connector according to claim 1 wherein said locking arm in said space includes a catch releasably engageable with said latching arm.

3. A connector according to claim 1 wherein in said passive position, said locking arm is engageable with the side of said latching arm to prevent insertion of said locking arm into said space.

4. A connector according to claim 2 wherein in said passive position, said locking arm is engageable with the side of said latching arm to prevent insertion of said locking arm into said space.

5. A connector according to claim 1 wherein said locking arm resumes an unbent state when fully inserted into said space.

6. A connector according to claim 1 wherein said second housing includes guide means adapted to guide said detector means into said space.

7. A connector according to claim 6 wherein said guide means comprises a projection of said second housing and a co-operating channel of said detecting member.

8. A connector according to claim 1 wherein said detecting member comprises a body portion from which protrudes said locking arm, the body portion and locking arm being separated by a slot extending at right angles to said fitting direction.

9. A connector according to claim 1 wherein said locking arm comprises a cantilever.

* * * * *